US007458317B2

(12) United States Patent
Sebastian et al.

(10) Patent No.: US 7,458,317 B2
(45) Date of Patent: Dec. 2, 2008

(54) CONTINUOUS BELT-TYPE BOARD PRESS

(75) Inventors: Lothar Sebastian, Duisburg (DE); Klaus Schürmann, Jüchen (DE); Horst Weiss, Krefeld (DE); Werner Thelen, Kempen (DE); Jürgen Frigger, Brilon (DE)

(73) Assignee: Siempelkamp Maschinen-und Anlagenbau GmbH & Co., Krefeld (DE)

( * ) Notice: Subject to any disclaimer, the term of this patent is extended or adjusted under 35 U.S.C. 154(b) by 968 days.

(21) Appl. No.: 10/402,246

(22) Filed: Mar. 28, 2003

(65) Prior Publication Data

US 2003/0213380 A1 Nov. 20, 2003

(30) Foreign Application Priority Data

Mar. 28, 2002 (DE) ..... 102 14 322

(51) Int. Cl.
*B27D 3/04* (2006.01)

(52) U.S. Cl. ..... 100/152; 100/306

(58) Field of Classification Search ..... 100/306, 100/307, 311, 313, 38, 152, 154
See application file for complete search history.

(56) References Cited

U.S. PATENT DOCUMENTS

| | | | | |
|---|---|---|---|---|
| 4,850,846 | A | 7/1989 | Walter | |
| 5,042,372 | A * | 8/1991 | Bielfeldt et al. | 100/38 |
| 5,775,214 | A | 7/1998 | Bielfeldt | |
| 6,098,532 | A * | 8/2000 | Sebastian et al. | 100/41 |
| 6,142,068 | A | 11/2000 | Sebastian | |
| 6,439,113 | B1 * | 8/2002 | Gawlitta et al. | 100/38 |

* cited by examiner

*Primary Examiner*—Shelley Self
(74) *Attorney, Agent, or Firm*—Andrew Wilford

(57) ABSTRACT

A press for pressing a mat into a thin panel has a press frame, upper and lower press plates on the frame, and upper and lower press belts having confronting lower and upper stretches defining a press gap extending in a horizontal and longitudinal transport direction and respectively running below and above the upper and lower press plates. Upper and lower flexible intake plates are juxtaposed respectively above and below upstream ends of the lower and upper stretches of the belts and define therewith a downstream portion of an intake mouth flaring upstream. Upper and lower rollers are respectively braced against the upper and lower stretches of the belts at an upstream portion of the intake mouth immediately upstream of the downstream portion of the intake mouth. Further actuators connected to the rollers set a shape of the upstream portion of the intake mouth.

3 Claims, 3 Drawing Sheets

CONTINUOUS BELT-TYPE BOARD PRESS

FIELD OF THE INVENTION

The present invention relates to continuous belt-type press. More particularly this invention concerns such a press used to make particle board, fiber board, plywood, and the like.

BACKGROUND OF THE INVENTION

In commonly owned U.S. Pat. Nos. 6,098,532 and 6,142,068 of Sebastian a continuous press for pressing a thick mat into a thin panel is described that has a press frame, upper and lower press belts having confronting lower and upper stretches defining a press gap extending in a horizontal transport direction, upper and lower flexible intake plates juxtaposed respectively above and below upstream ends of the lower and upper stretches of the upper and lower belts and defining therewith an intake mouth flaring upstream, and a plurality of hydraulic actuators braced between at least one of the intake plates and the frame and operable to deform the one plate and thereby change the spacings of the belts at the mouth. A desired shape of the one plate at the mouth is established in accordance with the thickness of the mat, the density of the mat, and the thickness of the panel. Then an actual shape of the one plate is detected by means of an array of position sensors, the detected actual shape of the one plate is compared to the desired shape, any variation between the actual shape and the desired shape is determined, and the actuators are pressurized to impart the desired shape to the one plate.

Another such press is described in U.S. Pat. No. 5,775,214 of Bielfeldt. It has a heating platen provided on one side of the press and a plurality of press-platen segments arranged on a side opposite to the heating platen. The press-platen segments are resiliently coupled to one another by snap-action hinges and the gap between the press-platen segments and the heating platen is independently adjusted. The workpiece being pressed is pulled through the gap which has been optimally set to produce boards with desired density profiles at a maximum production speed. The problem this patent is aimed at is premature wear of the steel belts caused by making them move around a sharp corner at the intake end of the pressing gap. The various segments of the press platen are set at different spacings to achieve the desired effect.

Finally, U.S. Pat. No. 4,850,846 of Walter describes an apparatus for hot pressing a pressed board mat used in making chipboard panels, fiberboard panels and pressed-board panels that comprises a continuously operating press with a lower press belt and an upper press belt and a conveyor with at least two endless conveyor belts adjoining each other. The press has an intake mouth in which the conveyor extends with a delivery nose directed in the feed direction up to a delivery region in the intake. The delivery nose is movable in the vertical direction, in the transport direction, and in a direction opposite to the transport direction and, because of that, the delivery region is displaceable in the entrance of the press according to the thickness of the pressed board mat to be pressed.

All these systems are relatively complex and do not adequately drive gas out of the mat as it enters the pressing gap. Gas is developed as the mat being press is, in effect, cooked as it passes through the press. Unless gas is driven out, it leads to excessive pressure buildup inside the press in the mat being pressed, as the gas cannot readily escape through the gas-impervious stainless-steel belts. The result is voids in the finished product.

OBJECTS OF THE INVENTION

It is therefore an object of the present invention to provide an improved continuous belt-type press.

Another object is the provision of such an improved continuous belt-type press which overcomes the above-given disadvantages, that is which effectively degasses the mat being pressed before it gets between the belts.

SUMMARY OF THE INVENTION

A press for pressing a mat into a thin panel has according to the invention a press frame, upper and lower press plates on the frame, and upper and lower press belts having confronting lower and upper stretches defining a press gap extending in a horizontal and longitudinal transport direction and respectively running below and above the upper and lower press plates. Respective arrays of roller rods are provided between each press plate and the respective stretch. Upper and lower flexible intake plates are juxtaposed respectively above and below upstream ends of the lower and upper stretches of the belts and define therewith a downstream portion of an intake mouth flaring upstream. Actuators connected to the intake plates set a shape of the downstream portion of the intake mouth. Upper and lower rollers are respectively braced against the upper and lower stretches of the belts at an upstream portion of the intake mouth immediately upstream of the downstream portion of the intake mouth. Further actuators connected to the rollers set a shape of the upstream portion of the intake mouth.

With the system of this invention the rollers at the upstream portion of the intake mouth create a precompression zone that degasses the incoming mat. The rollers allow the system to operate at high compression speeds for mats from 2 mm to more than 50 mm thick. The invention is based on the recognition that the already provided rollers at the intake mouth can also be used to guide the steel belts so that the gases can be squeezed out of the mat is effected in the precompression zone, upstream of the intake plates, allowing these plates to be made shorter. With the press according to the invention the heated plates are used along their entire lungs for temperature and pressure treatment of the workpiece mat. As a result there is better heat transmission. Furthermore the instant invention creates a symmetrical intake so that heat and pressure are applied symmetrically to both sides of the workpiece.

According to a further feature of the invention the upper and lower rollers include a plurality of rollers braced against the upper and/or lower stretch. Normally in accordance with the invention the plurality of rollers is arrayed parallel to one another along a substantially circular arc. The radius of curvature of this arc is adjusted by the respective actuators in accordance with the thickness of the mat.

Thus according to the invention the rollers include a plurality of the upper rollers braced against the lower stretch and a single lower roller braced against the upper stretch, and the press further has a conveyor having a downstream end extending into the mouth for feeding the mat into the mouth and means for horizontally displacing the conveyor downstream end in the direction in accordance with mat thickness. Control means connected to the horizontal displacement means of the conveyor positions the downstream conveyor end in accordance with characteristics of the mat including its density, thickness, and desired panel thickness. With this system ensures that the mat is perfectly centered when delivered to the intake mouth at the precompression zone constituted by the upstream portion of the intake mouth. The conveyor, which can be a belt or tablet, is operated by a simple actuator to the desired vertical and horizontal position as determined by the controller in accordance with the characteristics of the mat being pressed, which characteristics have been preloaded into the controller's memory.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
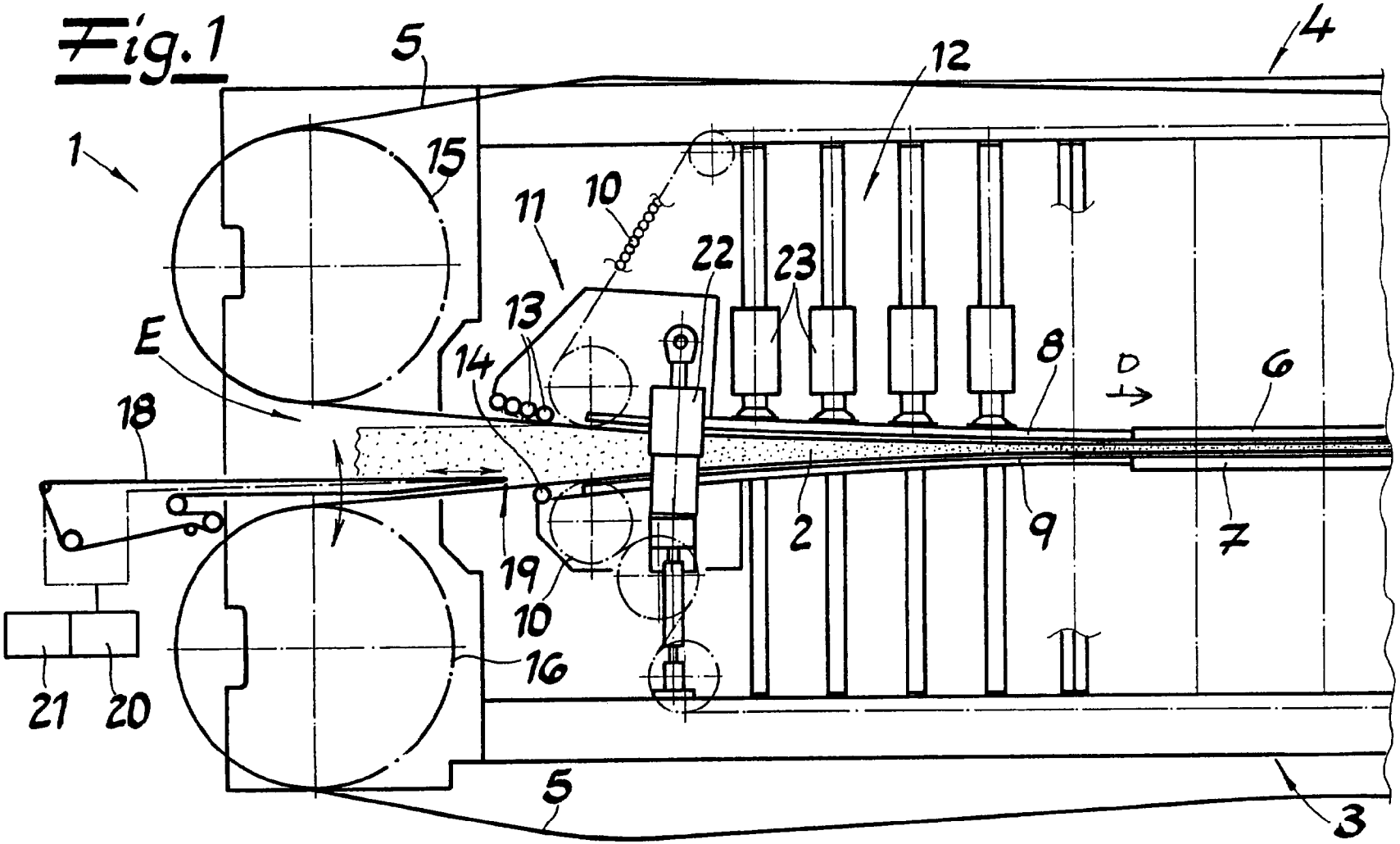
FIG. 1 is a side partly diagrammatic vertical section through the input end of the press according to the invention.
Figure 2:
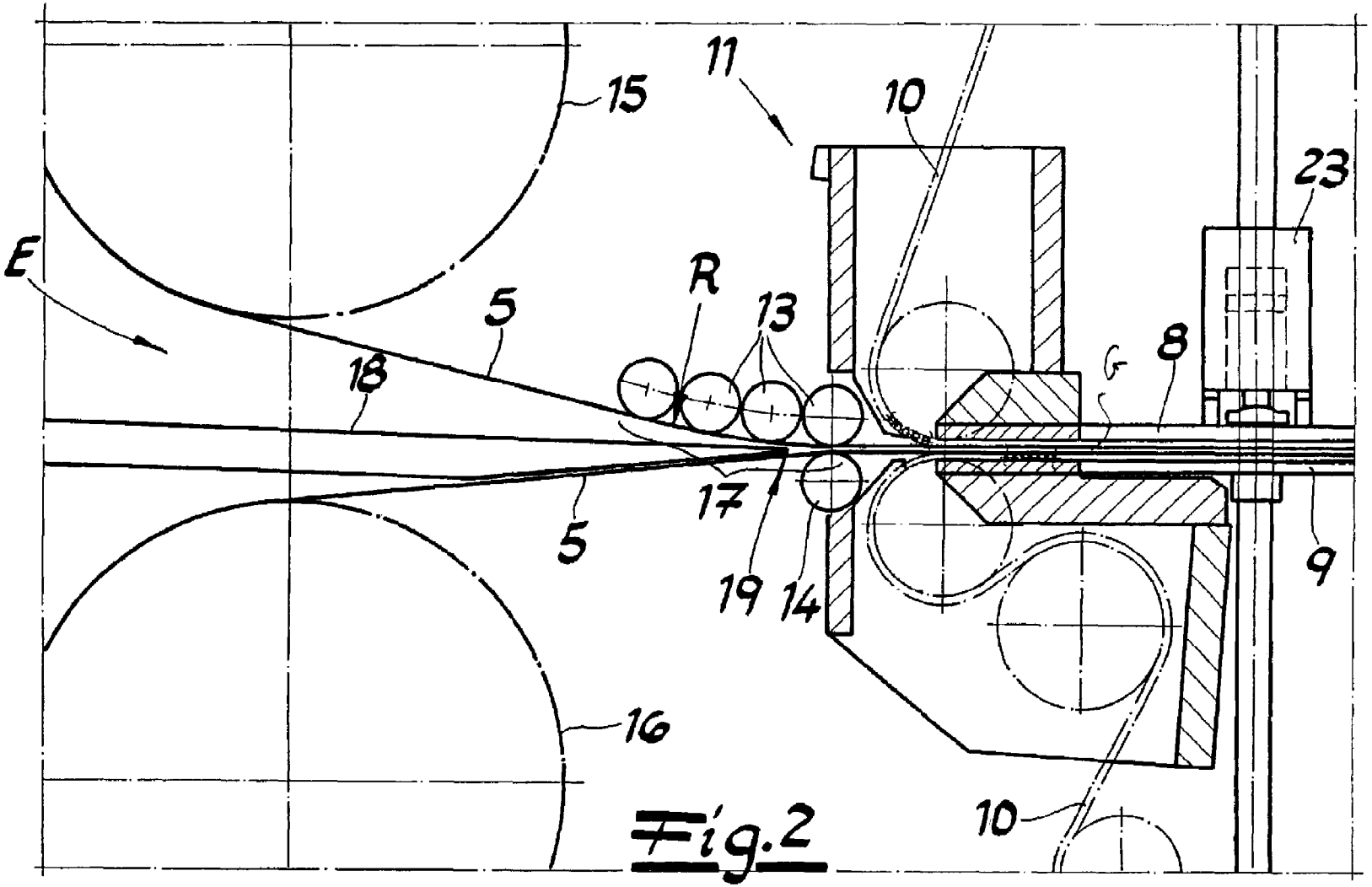
FIG. 2 is a large-scale view of a detail of FIG. 1 set for a thin board.
Figure 3:
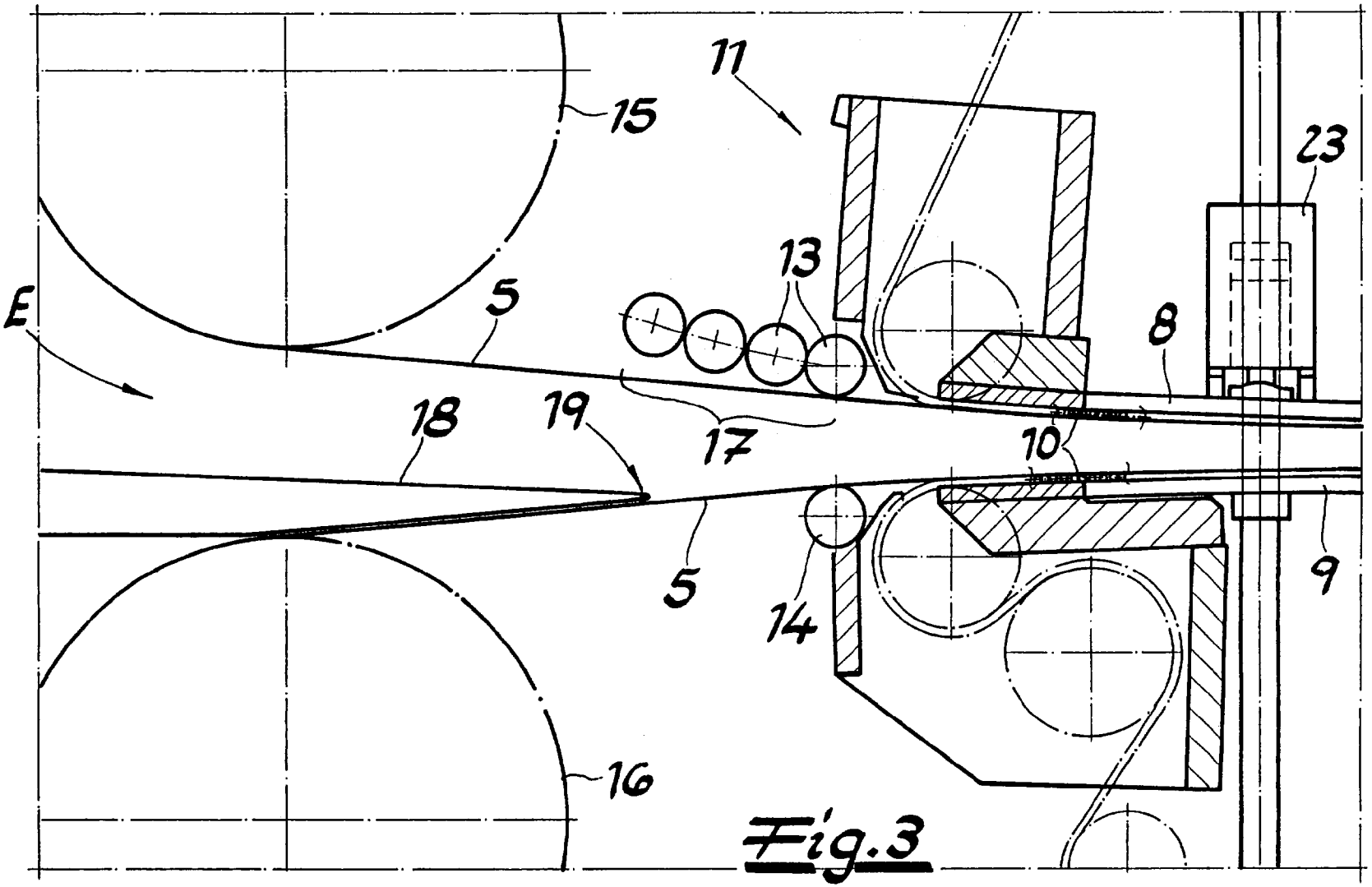
FIG. 3 is a view like FIG. 2 but set for a thicker board.

As seen in FIGS. 1 and 2 a press 1 according to the invention serves to compress a mat 2 of particles and binder. It has a frame formed by a lower part 3 and an upper part 4. A pair of endless stainless-steel belts 5 have confronting lower and upper stretches riding over heated press platens 6 and 7 and flexible intake plates 8 and 9 to define a pressing gap G extending in a horizontal mat transport direction D and having an intake mouth E that opens upstream in the direction D at upper and lower drums 15 and 16 over which the belts 5 are looped. Respective arrays of roller rods 10 ride between the belts 5 and the plates 6-9 to allow the belts 5 to move smoothly with little friction. The gap G starts at the intake mouth E where it is relatively wide to accommodate the mat 2 which can be as much as 100 mm thick to start with and ends at a spacing S equal to the thickness of the finished panel, typically around 16 mm.

The press 1 has upstream and downstream systems 11 and 12 for setting the shape of the belts 5 at respective upstream and downstream portions of the mouth E. Heated plates 8 and 9 are provided at the intake mouth E and along the gap G. The system 12 comprises a plurality of actuators constituted as hydraulic differential or double-acting cylinders 23 braced between the press part 3 and/or 4 and the plates 8 and/or 9. A common controller 21 is connected to the array of actuators 23 to control them individually.

The upstream shape-setting system 11 according to the invention comprises an array of upper rollers 13 bearing downward on the upper belt 5 at the mouth E between the drum 15 and the plate 8 and at least one lower roller 14 bearing upward on the lower belt 5 at the mouth E between the drum 16 and the plate 9. The roller 14 directly confronts the furthest downstream roller 13. A precompression zone 17 for the mat 2 is formed between the rollers 13 and 14.

A belt-type transfer conveyor 18 has a downstream end 19 projecting into the mouth E. The horizontal position of this end 19, that is how far it projects into the mouth, depends on the thickness, density, and consistency of the mat 2 being pressed and is set by an actuator 20 also operated by the controller 21. The controller can also position the end 19 in accordance with the desired finished panel thickness, and can move this end 19 vertically, that is perpendicular to the direction D, if necessary. A double-acting actuator 22 connected between the upper rollers 13 and lower roller(s) 14 is also operated by the controller 21 and serves to set the shape of the precompression zone 17.

The upper rollers 13 lie on a circular arc having a radius R that is a function of the thickness of the mat 2. The actuators 23 set the shape of the mouth E by positioning the plates 8 and 9.

We claim:

1. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

respective arrays of roller rods between each press plate and the respective stretch;

upper and lower flexible intake plates juxtaposed respectively above and below upstream ends of the lower and upper stretches of the belts and defining therewith a downstream portion of an intake mouth flaring upstream;

a plurality of the upper rollers braced against the lower stretch at an upstream portion of the intake mount immediately upstream of the downstream portion of the intake mouth;

a single lower roller braced against the upper stretch at the upstream portion of the intake mouth;

means including actuators connected to the rollers for setting a shape of the upstream portion of the intake mouth;

a conveyor having a downstream end extending into the mouth for feeding the mat into the mouth; and means for horizontally displacing the conveyor downstream end in the direction in accordance with mat thickness.

2. The panel press defined in claim 1 wherein the plurality of upper rollers are arrayed parallel to one another along a substantially circular arc.

3. The panel press defined in claim 1, further comprising control means connected to the horizontal displacement means of the conveyor for positioning the downstream conveyor end in accordance with characteristics of the mat including its density, thickness, and desired panel thickness.

* * * * *